US008991674B2

(12) United States Patent
Lee

(10) Patent No.: US 8,991,674 B2
(45) Date of Patent: Mar. 31, 2015

(54) ADHESIVE-TAPE CUTTING DEVICE

(71) Applicant: Boy Lee, Taichung (TW)

(72) Inventor: Boy Lee, Taichung (TW)

( * ) Notice: Subject to any disclaimer, the term of this patent is extended or adjusted under 35 U.S.C. 154(b) by 97 days.

(21) Appl. No.: 13/895,426

(22) Filed: May 16, 2013

(65) Prior Publication Data

US 2013/0306697 A1 Nov. 21, 2013

(30) Foreign Application Priority Data

May 18, 2012 (TW) ..... 101117774 A

(51) Int. Cl.
*B65H 35/00* (2006.01)
*B29C 65/00* (2006.01)

(52) U.S. Cl.
CPC ..... *B65H 35/0033* (2013.01); *B65H 35/0026* (2013.01)
USPC ..... 225/65; 225/66; 225/91; 156/250; 156/510

(58) Field of Classification Search
USPC ..... 225/65, 58, 56, 67, 89, 91, 57, 66; 156/250, 510, 577
See application file for complete search history.

(56) References Cited

U.S. PATENT DOCUMENTS 2,229,961 A * 1/1941 Deane ..... 225/19
2,655,214 A * 10/1953 Van Cleef ..... 225/65
2,788,181 A * 4/1957 Anderson ..... 225/65
3,283,977 A * 11/1966 Schluchter ..... 225/65
3,395,841 A * 8/1968 Brown ..... 225/65
3,556,367 A * 1/1971 Ikeda ..... 225/65
3,684,141 A * 8/1972 Hall ..... 225/65
3,693,853 A * 9/1972 Siegal ..... 225/58
4,957,234 A * 9/1990 Orlandini ..... 225/65
4,961,525 A * 10/1990 Corbo et al. ..... 225/65
D317,984 S * 7/1991 Reynoso et al. ..... D3/215
5,551,646 A * 9/1996 Goldstein ..... 242/419
5,788,807 A * 8/1998 Gratz ..... 156/577
7,014,081 B2 * 3/2006 Ortin et al. ..... 225/65
7,841,498 B1 * 11/2010 Rohrer ..... 225/65
7,861,904 B1 * 1/2011 Taylor et al. ..... 225/65
8,215,527 B2 * 7/2012 Fathi ..... 225/51
8,474,504 B2 * 7/2013 Vulpitta ..... 156/577
8,839,838 B2 * 9/2014 Parkhe ..... 156/577
2010/0096427 A1 * 4/2010 Chen ..... 225/56
2010/0258606 A1 * 10/2010 Wu ..... 225/58

* cited by examiner

*Primary Examiner* — Omar Flores Sanchez
(74) *Attorney, Agent, or Firm* — Trop, Pruner & Hu, P.C.

(57) ABSTRACT

An adhesive tape cutting device includes a cutting member and a supporting unit. The supporting unit includes a shaft seat mounted to the outer surface of an adhesive tape roll, a first pressing member disposed on the shaft seat, and a first supporting member disposed on the shaft seat. The cutting member is disposed on the shaft seat. The first pressing member has a biasing rod section extending from the shaft seat, and a pressing portion pressing against an inner surface of the adhesive tape roller. The first supporting member has a biasing rod section extending from the shaft seat such that the biasing rod sections of the first pressing member and the first supporting member flank the adhesive top roll, and a retaining portion retaining removably the pressing portion thereon.

9 Claims, 10 Drawing Sheets

ADHESIVE-TAPE CUTTING DEVICE

CROSS-REFERENCE TO RELATED APPLICATION

This application claims priority of Taiwanese Application No. 101117774, filed on May 18, 2012.

BACKGROUND OF THE INVENTION

1. Field of the Invention

This invention relates to a cutting device, and more particularly to an adhesive-tape cutting device.

2. Description of the Related Art

Referring to FIG. 1, a conventional adhesive-tape cutting device 6 is used widely to cut an adhesive tape roll 5. Since the adhesive-tape cutting device 6 is bulky, and is made of metal, it is inconvenient to carry and store, and is made at a high cost. Furthermore, undesired adhesion of a peeled tape section 51 to the rolled section of the adhesive tape roll 5 may usually occur, thereby resulting in inconvenience during use.

SUMMARY OF THE INVENTION

The object of this invention is to provide an adhesive-tape cutting device that can overcome the above-mentioned drawbacks associated with the prior art.

According to this invention, an adhesive tape cutting device includes a cutting member and a supporting unit. The supporting unit includes a shaft seat mounted to the outer surface of an adhesive tape roll, a first pressing member disposed on the shaft seat, and a first supporting member disposed on the shaft seat. The cutting member is disposed on the shaft seat. The first pressing member has a biasing rod section extending from the shaft seat, and a pressing portion pressing against an inner surface of the adhesive tape roller. The first supporting member has a biasing rod section extending from the shaft seat such that the biasing rod sections of the first pressing member and the first supporting member flank the adhesive top roll, and a retaining portion retaining removably the pressing portion thereon.

Since the pressing portion of the first pressing member is biased to press against the inner surface of the adhesive tape roll, relative movement between the adhesive tape cutting device and the adhesive roll can be prevented.

Preferably, the cutting unit further includes two return plates extending from the first pressing member and the first supporting member, respectively. When a force is applied to press downwardly the cutting member against the return plates and when the peeled tape section is cut off, free ends of the return plates are moved downwardly, and when the force is released, the free ends of the return plates return to their original positions to thereby pivot upwardly the cutting member and move upwardly a portion of the peeled tape section remaining on a rolled section of the adhesive tape roll, so that a free end of the portion of the peeled tape section adjacent to the blade is removed from the rolled section of the adhesive tape roll. As such, the peeled tape section cannot be adhered undesirably to the rolled section of the adhesive tape roll.

With the above structures, the adhesive-tape cutting device can be made of a plastic material, is compact, and is thus convenient to carry and store. Furthermore, the manufacturing cost of the adhesive-tape cutting device is reduced, as compared to the above-mentioned prior art.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
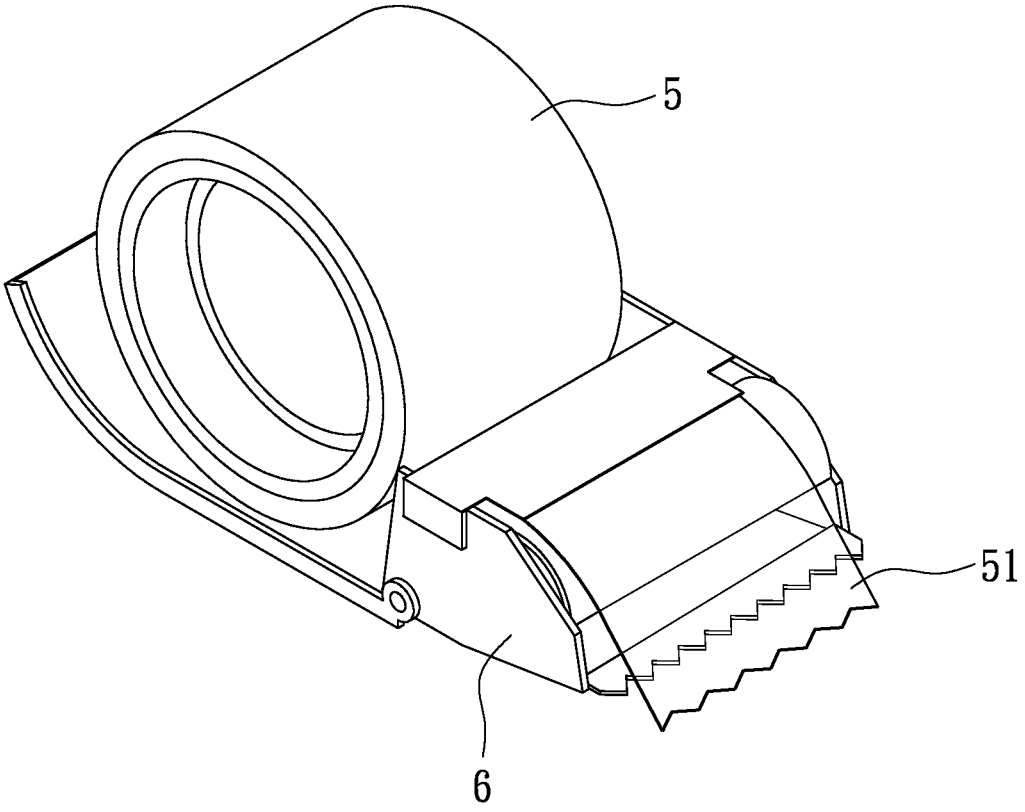
FIG. 1 PRIOR ART
FIG. 1 is a perspective view of a conventional adhesive-tape cutting device.

Referring to FIGS. 2, 3, 4, and 5, the preferred embodiment of an adhesive-tape cutting device according to this invention is usable with an adhesive tape roll 9. The adhesive tape roll 9 has a first side surface 91, a second side surface 92 opposite to the first side surface 91, a peeled tape section 93, an inner surface 94, and an outer surface 95 opposite to the inner surface 94. The adhesive-tape cutting device includes a supporting unit 3 and a cutting unit 4.

The supporting unit 3 includes an elongated shaft seat 30 mounted to the outer surface 95 of the adhesive tape roll 9, first and second pressing members 31, 32 disposed on an end of the shaft seat 30 and adjacent to the first side surface 91 of the adhesive tape roll 9, and first and second supporting members 33, 34 disposed on an opposite end of the shaft seat 30 and adjacent to the second side surface 92 of the adhesive tape roll 9.

The shaft seat 30 includes two pivot pins 301 extending respectively and outwardly from two opposite ends thereof away from each other. The first pressing member 31 and the first supporting member 33 are located at a side of the shaft seat 30. The second pressing member 32 and the second supporting member 34 are located at an opposite side of the shaft seat 30. Each of the first and second pressing members 31, 32 has a biasing rod section 311, 321 and a pressing portion 312, 322. The biasing rod sections 311, 321 of the first and second pressing members 31, 32 extend from the shaft seat 30 away from each other. Each of the pressing portions 312, 322 is configured as a rod, and has an enlarged (i.e., diameter-increased) free end 313, 323, and an engaging portion 314, 324 adjacent to the enlarged free end 313, 323. The first pressing member 31, the second pressing member 32, the first supporting member 33, and the second supporting member 34 are made of a flexible material.

Each of the first and second supporting members 33, 34 has a biasing rod section 331, 341 extending from the shaft seat 30, and a retaining portion 332, 342 disposed on the biasing rod section 331, 341. As such, the first pressing member 31 and the first supporting member 33 flank the adhesive tape roll 9. Similarly, the second pressing member 32 and the second supporting member 34 flank the adhesive tape roll 9.

The engaging portions 314, 324 of the first and second pressing members 31, 32 are retained respectively and removably on the retaining portions 332, 342 of the first and second supporting members 33, 34.

The cutting unit 4 includes a cutting member 41 connected pivotally to the pivot pins 301 of the shaft seat 30, two return plates 42 extending respectively from the first pressing member 31 and the first supporting member 33 toward each other, a push block 43 extending outwardly from the cutting member 41, a pressing plate 44 disposed on the cutting member 41, and two pairs of positioning plates 45 disposed on the pressing plate 44. In this embodiment, the cutting member 41 has two parallel pivot arms 410, and two C-shaped retaining rings 410' sleeved respectively and movably on the pivot pins 301 and connected respectively to ends of the pivot arms 410, and a blade 411. The cutting member 41 is rotatable relative to the return plates 42 between a non-cutting position shown in FIG. 7 and a cutting position shown in FIG. 8. A tape passage space 421 is defined between the shaft seat 30 and the return plates 42 so as to allow the peeled tape section 93 to extend through the tape passage space 421 to thereby be adhered to the return plates 42. A finger passage space 422 is defined between the return plates 42 so that the peeled tape section 93 can be taken out therethrough. The return plates 42 are flexible. Each pair of positioning plates 45 define a plate-receiving space 451 therebetween. The return plates 42 are engageable respectively with the plate-receiving spaces 451 defined by the positioning plates 45.

In this embodiment, the blade 411 is made of a plastic material. The cutting member 41 is formed as one piece so as to reduce the manufacture and assembly costs and promote safety during use.

In this embodiment, each supporting portion 332, 342 is shaped as a hook.

Figure 3:
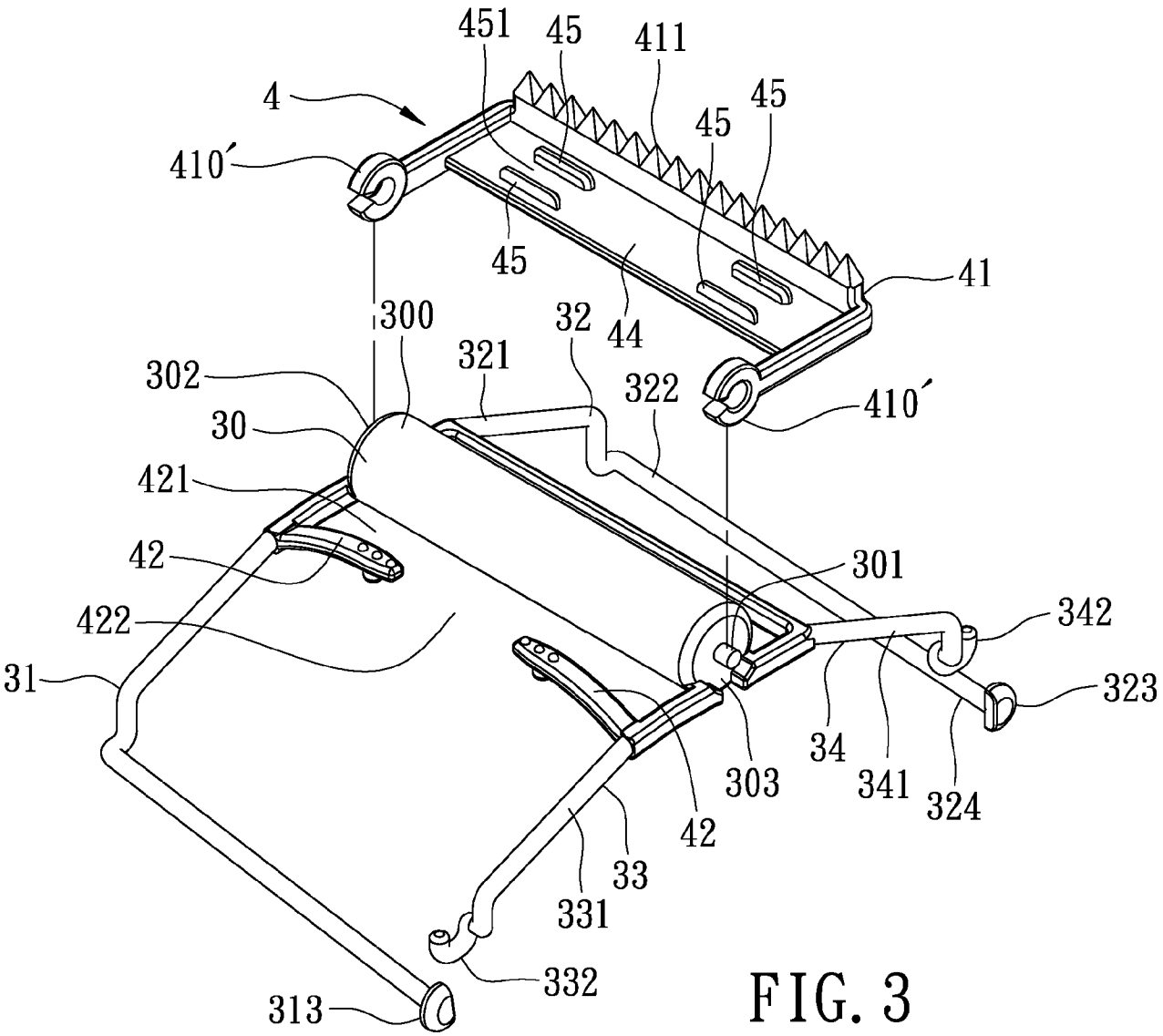
FIG. 3 is an exploded perspective view of the preferred embodiment, viewed at a different angle.
Figure 4:
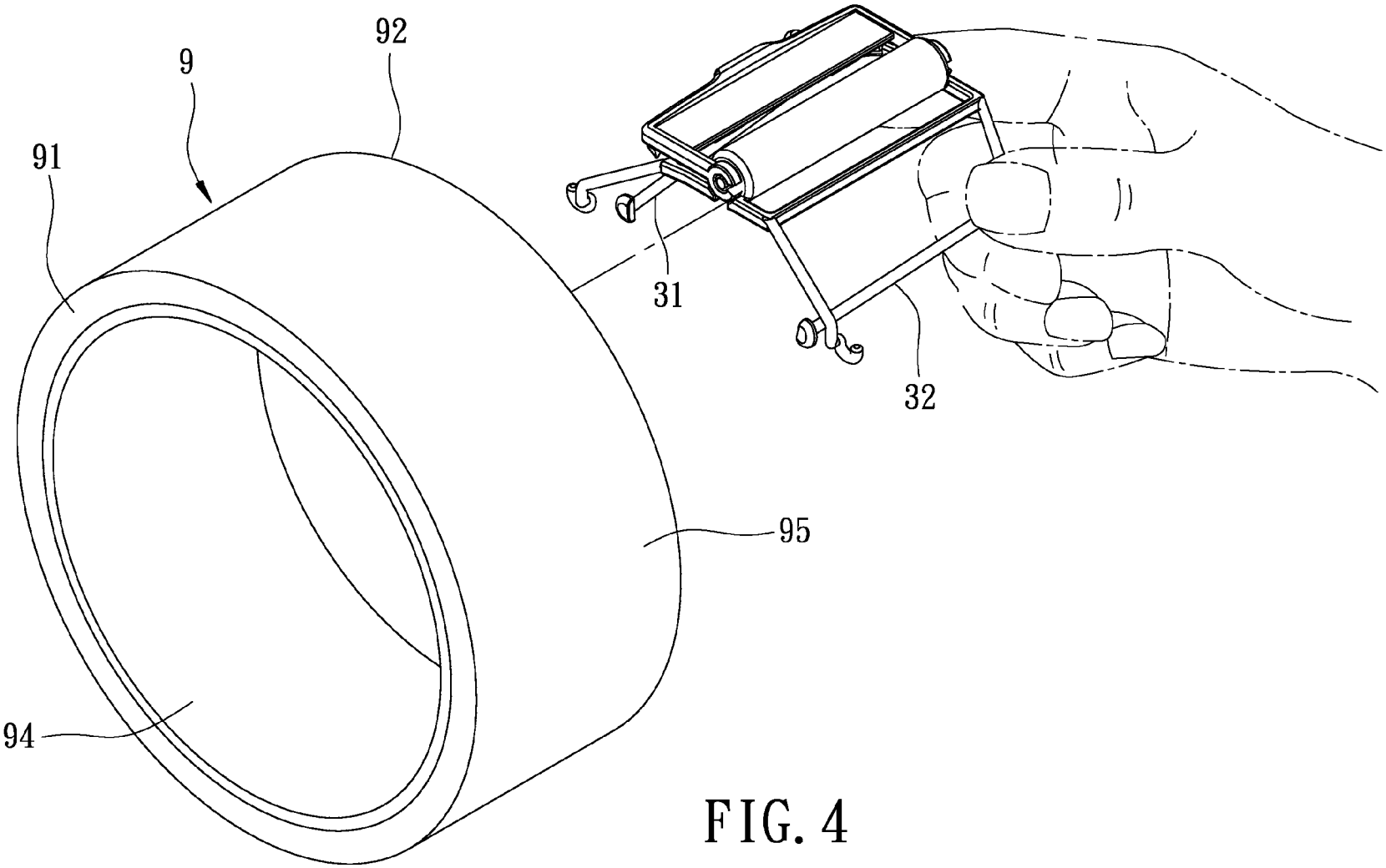
FIGS. 4-6 are schematic views illustrating how the preferred embodiment is mounted to the adhesive tape roll.

With particular reference to FIG. 3, when it is desired to mount the adhesive-tape cutting device to the adhesive tape roll 9, the engaging portions 314, 324 are first removed from the retaining portions 332, 342, respectively, as shown in FIG. 4. Next, the pressing portions 312, 322 are flexed and inserted into the adhesive tape roll 9 such that the adhesive tape roll 9 is located between the shaft seat 30 and the first and second pressing portions 312, 322, between the biasing rod sections 311, 321 of the first and second pressing members 31, 32, and between the biasing rod sections 331,341 of the first and second supporting members 33,34.

Figure 5:
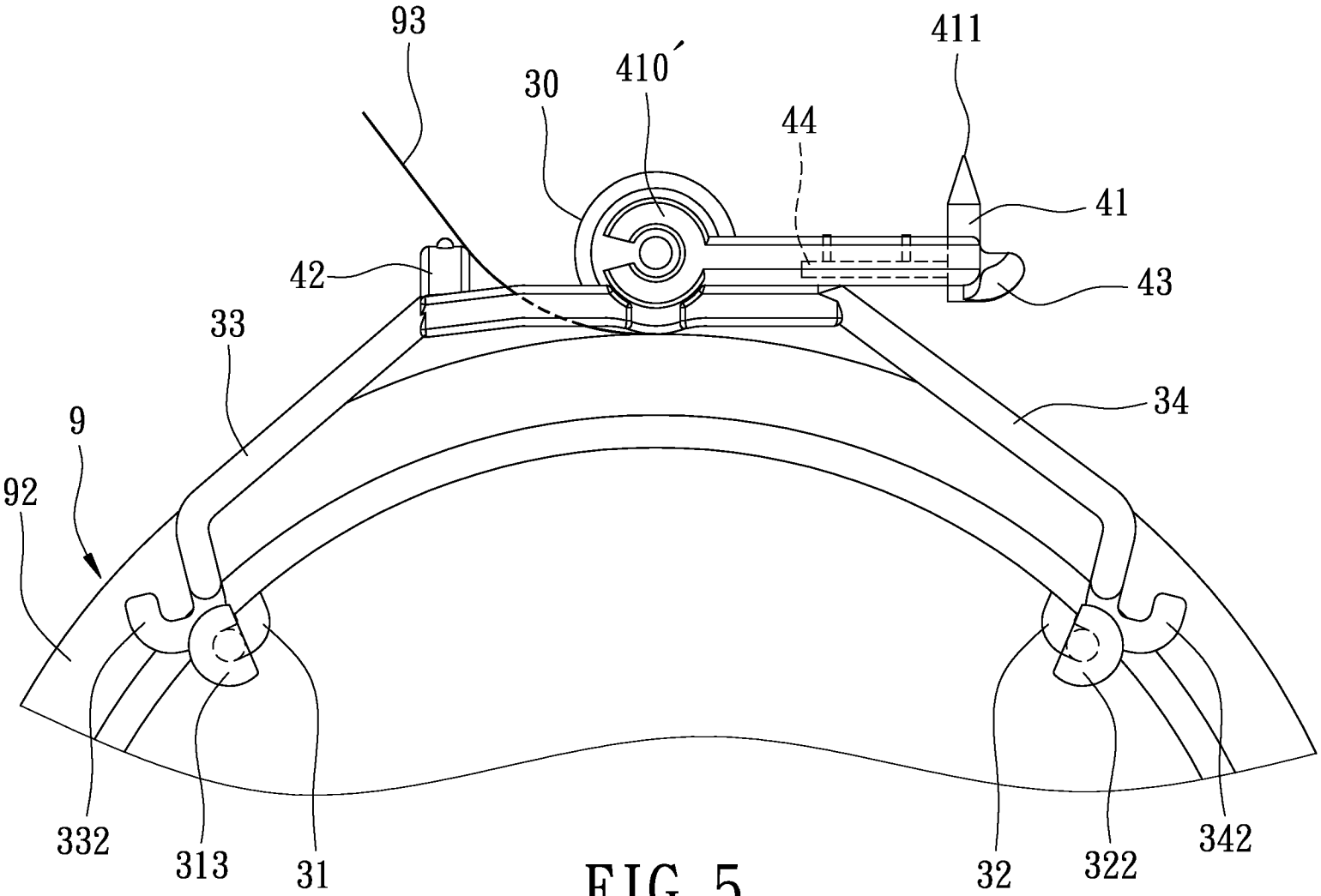
Figure 6:
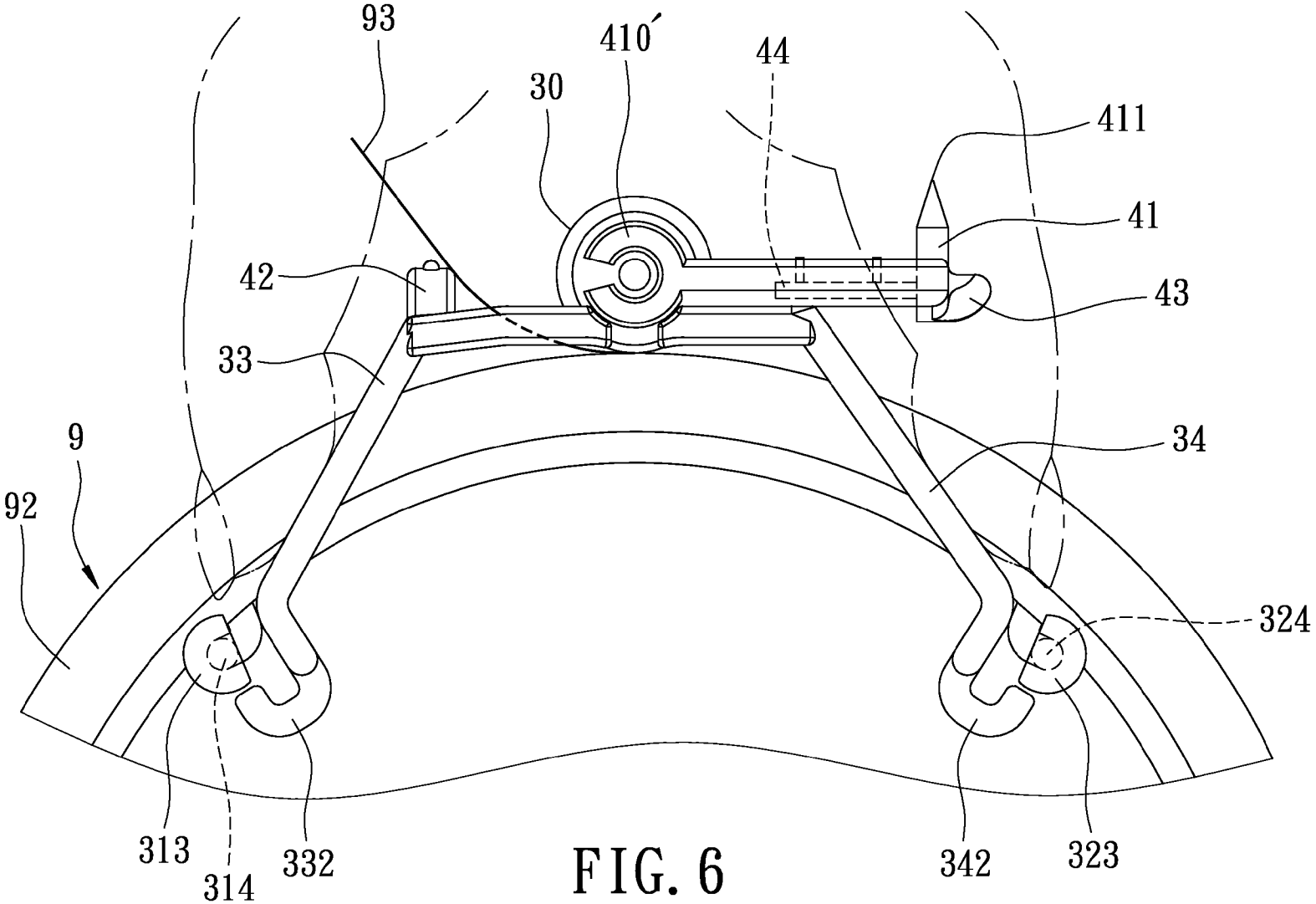
Figure 7:
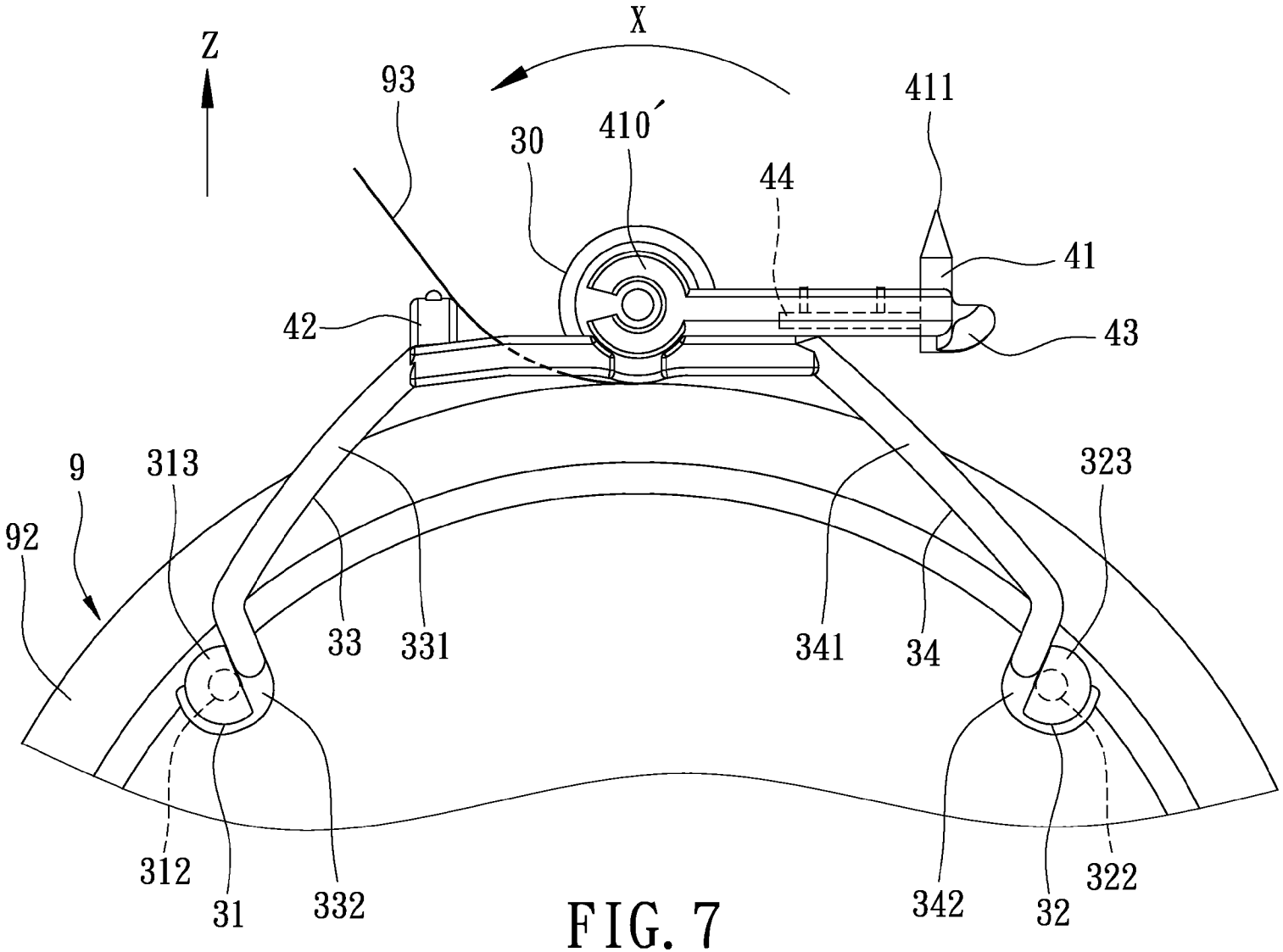
FIG. 7 is a schematic side view of the preferred embodiment, illustrating a non-cutting position of a cutting member.

With particular reference to FIG. 5, when the fingers of the user are removed from the first and second pressing members 31, 32, the pressing portions 312, 322 of the first and second pressing members 31, 32 are biased by the biasing rod sections 311, 321 to press against the inner surface 94 of the adhesive tape roll 9. Afterwards, the pressing portions 312, 322 are flexed again, as shown in FIG. 6, so as to engage the engaging portions 314, 324 with the retaining portions 332, 342, respectively, followed by removing the fingers of the user from the adhesive-tape cutting device, as shown in FIG. 7. Hence, the pressing portions 312, 322 are biased to press against the inner surface 94 of the adhesive tape roll 9, such that the biasing rod sections 311, 321 are slightly flexed. As a consequence, the adhesive tape roll 9 is clamped resiliently by the adhesive-tape cutting device for preventing relative movement therebetween. At this time, the peeled tape section 93 can be pulled out through the tape passage space 421, and can be used. Such a mounting process is efficient and cost-effective, and meets current environmental protection requirement.

Figure 2:
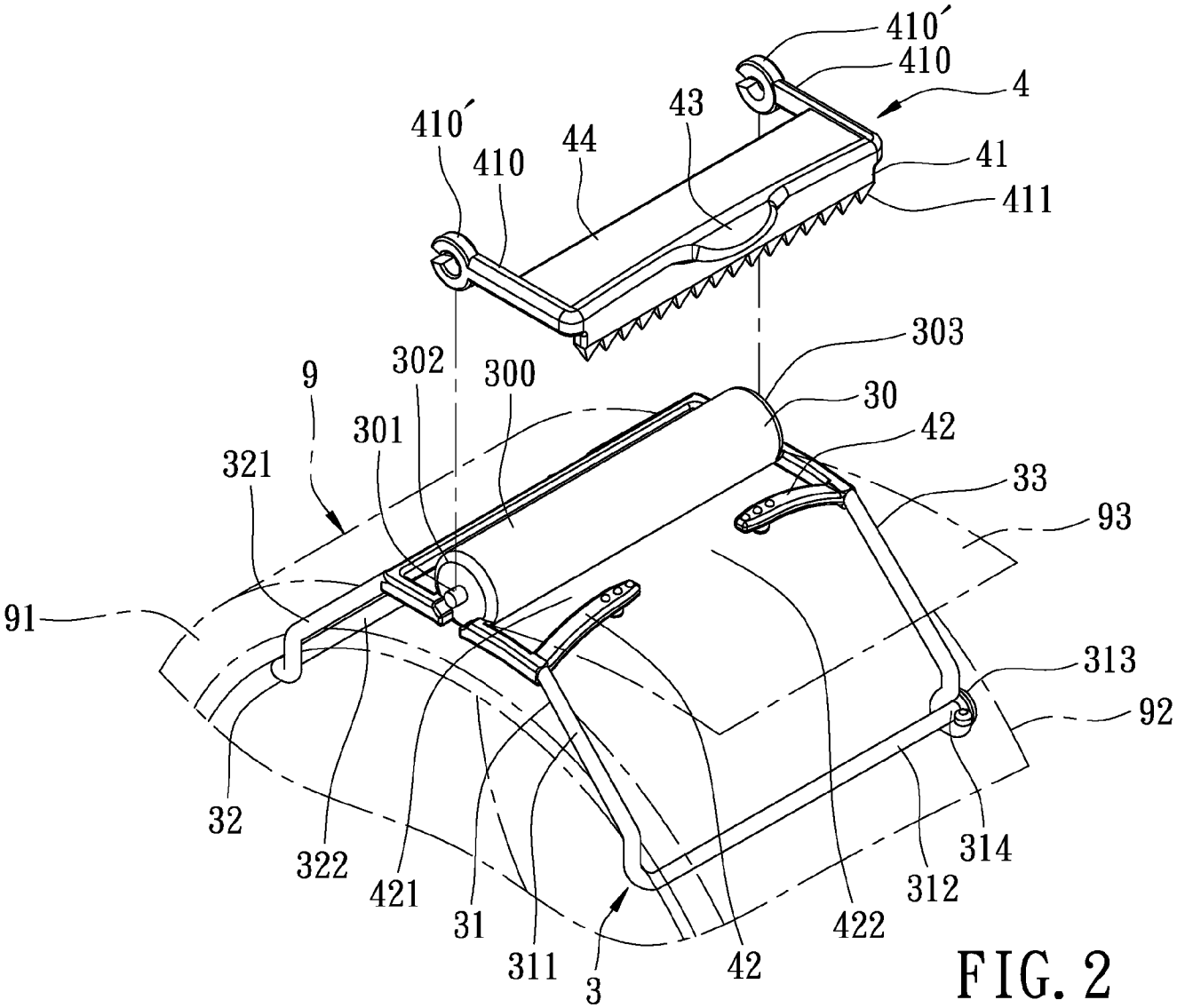
FIG. 2 is an exploded perspective view of the preferred embodiment of an adhesive-tape cutting device according to this invention, illustrating that it is mounted to an adhesive tape roll.

With particular reference to FIGS. 2 and 7, to cut the peeled tape section 93, a force is applied to the push block 43 to rotate the cutting member 41 to the non-cutting position. At this time, the cutting member 41 is far away from the return plates 42, so that the fingers of the user can be extended through the finger passage space 422 for pulling out the peeled tape section 93 through the tape passage space 421 in an upward direction (Z) by an appropriate length. Subsequently, the cutting member 41 is rotated in a counterclockwise direction (X) from the non-cutting position to the cutting position.

Figure 8:
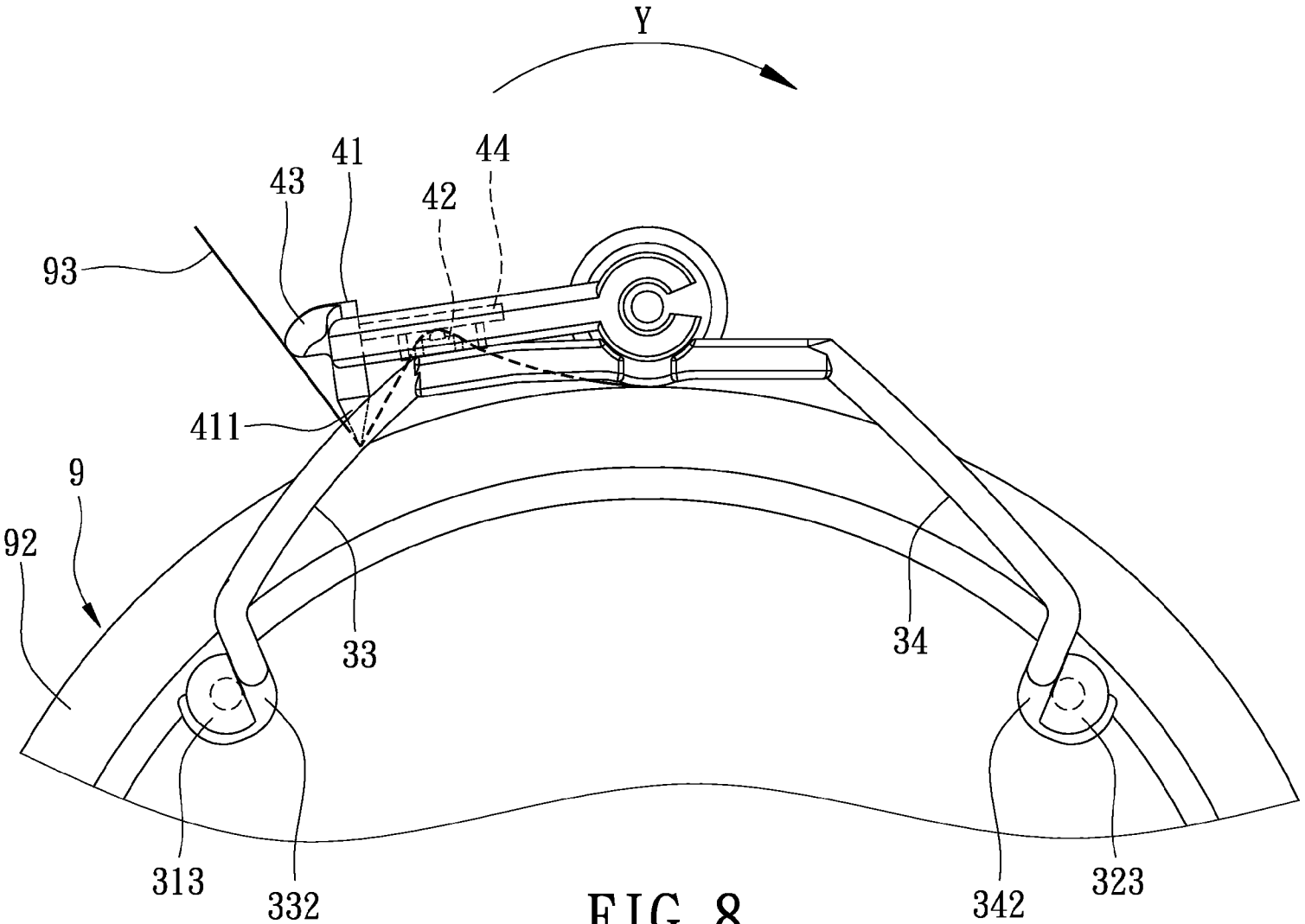
FIG. 8 is a schematic side view of the preferred embodiment, illustrating a cutting position of the cutting member.

With particular reference to FIG. 8, in the cutting position, the cutting member 41 can be pressed downwardly to move free ends of the return plates 42 downwardly, so that the blade 411 presses the peeled tape section 93 against the outer surface 95 of the adhesive tape roll 9, thereby allowing the peeled tape section 93 to be cut off.

Figure 9:
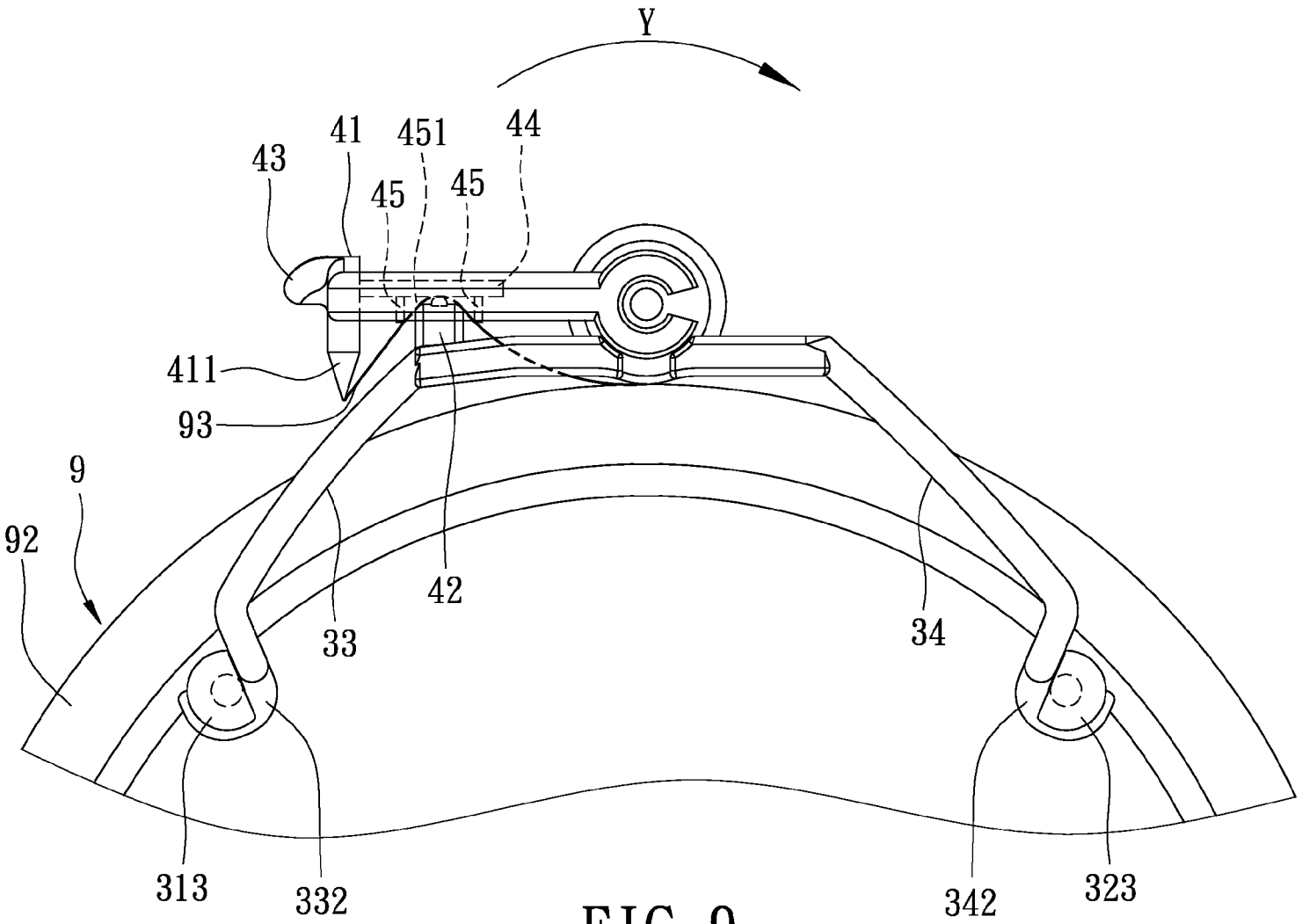
FIG. 9 is a schematic side view of the preferred embodiment, illustrating operation of the adhesive-tape cutting device after the cutting member is pressed and then released.

With particular reference to FIGS. 3 and 9, after the peeled tape section 93 is cut off, and when the cutting member 41 is released, the free ends of the return plates 42 return upwardly to their original positions to thereby pivot upwardly the cutting member 41 and move upwardly a portion of the peeled tape section 93 remaining on the rolled section of the adhesive tape roll 9, so as to remove the blade 411 and the portion of the peeled tape section 93 from the rolled section of the adhesive tape roll 9, thereby preventing an adhesive-coated side surface of the portion of the peeled tape section 93 from contact with the rolled section of the adhesive tape roll 9. At this time, the return plates 42 are received respectively within the plate-receiving spaces 451 defined by the positioning plates 45, and the pressing plate 44 cooperates with the return plates 42 and the positioning plates 45 so as to clamp the portion of the peeled tape section 93 thereamong, thus further preventing the adhesive-coated side surface of the portion of the peeled tape section 93 from contact with the rolled section of the adhesive tape roll 9.

When continued use is desired, the push block 43 is rotated back to the non-cutting position in the direction (Y). Thereafter, the peeled tape section 93 can be further pulled out through the finger passage space 422 for continued use.

With particular reference to FIG. 7, when the cutting member 41 is at the non-cutting position, the adhesive-coated side surface of the peeled tape section 93 is adhered to the return plates 42 such that a free end of the peeled tape section 93 is curved upwardly, thereby allowing the peeled tape section 93 to be held conveniently.

It should be noted that, when the cutting member 41 is at the non-cutting position, a top end of the blade 411 is not higher than a top end of the shaft seat 30. As such, when the peeled tape section 93 is taken out of the finger passage space 422, it is more unlikely to contact the blade 411.

It should be noted that, since all components of the adhesive-tape cutting device can be plastics, and since the number of the components is reduced, as compared to that of the components of the above-mentioned conventional adhesive-tape cutting device, the adhesive-tape cutting device can be made at a low cost.

It should be noted that, the adhesive-tape cutting device is not limited to cut the adhesive tape roll 9. In other words, the adhesive-tape cutting device of this invention can be used to cut a roll of any plate-shaped elongate article.

Figure 10:
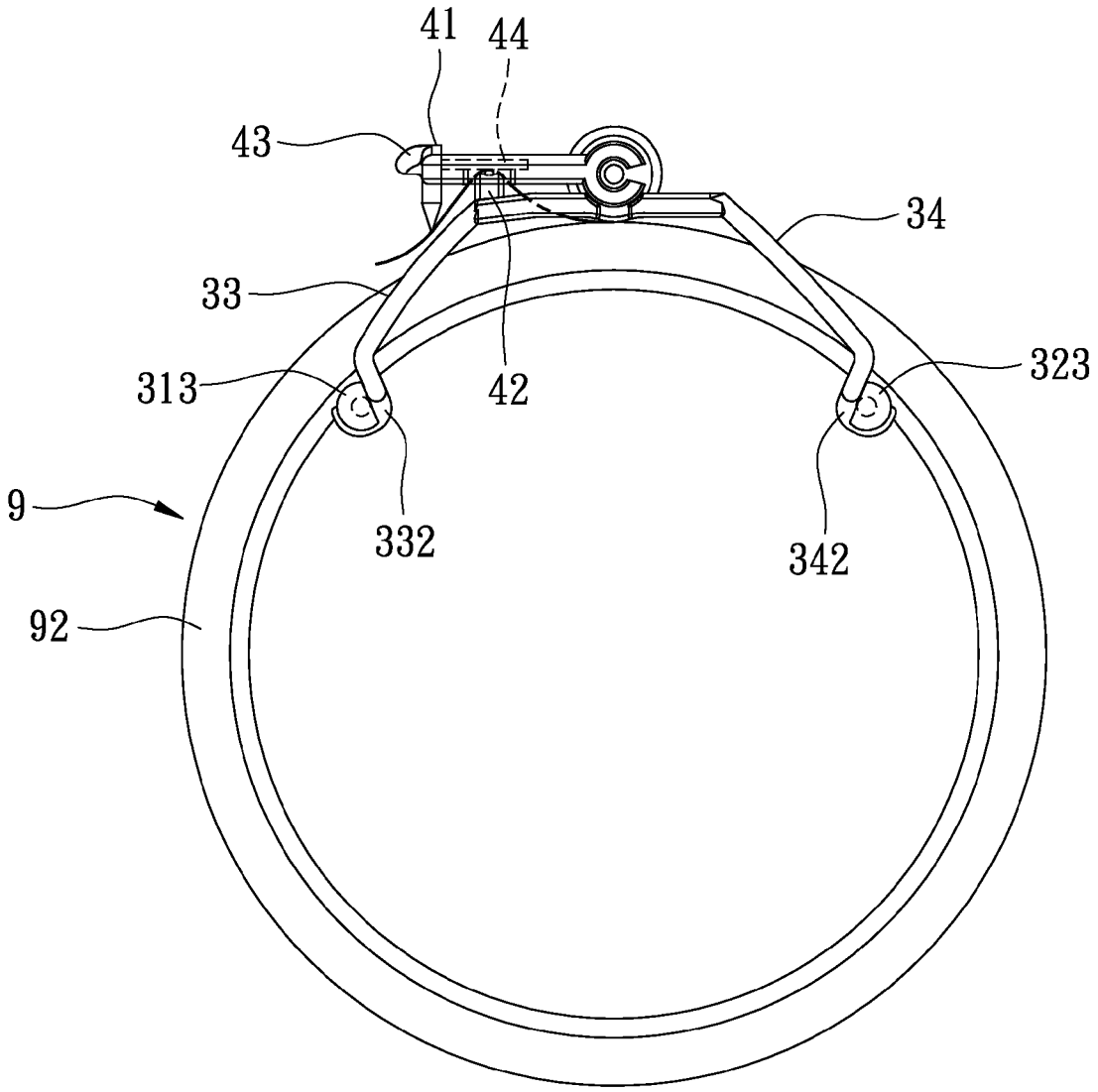
FIG. 10 is a schematic side view of the preferred embodiment and the adhesive tape roll, which are assembled together to form a unit to be sold.

With particular reference to FIGS. 2 and 10, if necessary, the adhesive-tape cutting device can be assembled to the adhesive tape roll 9 to form a unit to be sold.

To sum up, the adhesive-tape cutting device of this invention has the following advantages:

1. Since the peeled tape section 93 is adhered to the return plates 42, and since the return plates 42 cooperate with the pressing plate 44 and the positioning plates 45 to clamp the peeled tape section 93 thereamong during cutting, undesired adhesion of the peeled tape section 93 to the rolled section of the adhesive tape roll 9 can be prevented. This can promote the cutting efficiency.

2. Since the return plates 42 are flexible and resilient, after cutting, they can return to their original positions by virtue of self-resilience thereof to thereby remove the peeled tape section 93 from the rolled section of the adhesive tape roll 9. Hence, the peeled tape section 93 is clamped among the return plates 42, the pressing plate 44, and the positioning plates 45. As a result, even when in not use, undesired adhesion of the peeled tape section 93 to the rolled section of the adhesive tape roll 9 can be prevented.
3. Through cooperation of the first and second pressing members 31, 32 with the first and second supporting members 33, 34, a portion of the adhesive tape roll 9 is clamped between the shaft seat 30 and the pressing portions 312, 322. In this manner, when the portion of the adhesive tape roll 9 is used and thus thinned, it still can be clamped between the shaft seat 30 and the pressing portions 312, 322. Furthermore, the clamping force can be easily overcome to allow for movement of the adhesive-tape cutting device on the adhesive tape roll 9 by pushing the adhesive-tape cutting device. Consequently, the adhesive-tape cutting device is convenient to use.
4. since the blade 411 can be made of a plastic material, the fingers of the user cannot be cut and hurt so as to promote effectively safety during use.
5. The adhesive-tape cutting device is compact, and all components of the adhesive-tape cutting device can be plastics, so as to reduce the manufacturing cost of the adhesive-tape cutting device. As such, it is more likely that the adhesive tape roll 9 and the adhesive-tape cutting device are sold simultaneously in such a manner that the portion of the adhesive tape roll 9 is clamped by the adhesive-tape cutting device. In this case, it is not necessary to assemble the adhesive-tape cutting device to the adhesive tape roll 9 by the user, thereby resulting in convenience during use.

With this invention thus explained, it is apparent that numerous modifications and variations can be made without departing from the scope and spirit of this invention. It is therefore intended that this invention be limited only as indicated by the appended claims.

I claim:

1. An adhesive tape cutting device adapted to be mounted to an adhesive tape roll, the adhesive tape roll having an inner surface, an outer surface opposite to the inner surface, a first side surface, a second side surface opposite to the first side surface, and a peeled tape section, said adhesive tape cutting device comprising:

a cutting unit including a cutting member that has a blade; and a supporting unit including an elongated shaft seat adapted to be mounted to the outer surface of the adhesive tape roll and permitting said cutting member to be disposed thereon, a first pressing member disposed on an end of said shaft seat and adapted to be adjacent to the first side surface of the adhesive tape roll, and a first supporting member disposed on an opposite end of said shaft seat and adapted to be adjacent to the second side surface of the adhesive tape roll, said first pressing member having a biasing rod section extending from said shaft seat and adapted to be adjacent to the second side surface of the adhesive tape roll, and a pressing portion extending from said biasing rod section toward said first supporting member and adapted to press against an inner surface of the adhesive tape roller, said first supporting member having a biasing rod section extending from said shaft seat such that said biasing rod sections of said first pressing member and said supporting member flank the adhesive top roll, and a retaining portion connected to said biasing rod section of said first supporting member and retaining removably said pressing portion of said first pressing member thereon, such that said biasing rod sections of said first pressing member and said first supporting member cooperate to bias said pressing portion of said first pressing member to press against the inner surface of the adhesive tape roll;

wherein said supporting unit further includes a second pressing member disposed on said shaft seat and adjacent to said first pressing member, and a second supporting member disposed on said shaft seat and adjacent to said first supporting member, such that said first pressing member and said first supporting member are located at a side of said shaft seat, and said second pressing member and said second supporting member are located at an opposite side of said shaft seat, said second pressing member having a biasing rod section extending from said shaft seat and adapted to be adjacent to the first side surface of the adhesive tape roll, and a pressing portion extending from said biasing rod section toward said second supporting member and adapted to press against an inner surface of the adhesive tape roller, said second supporting member having a biasing rod section extending from said shaft seat such that said biasing rod sections of said second pressing member and said supporting member flank the adhesive top roll, and a retaining portion connected to said biasing rod section of said second supporting member and retaining removably said pressing portion of said second pressing member thereon, such that said biasing rod sections of said second pressing member and said second supporting member cooperate to bias said pressing portion of said second pressing member to press against the inner surface of the adhesive tape roll.

2. The adhesive tape cutting device as claimed in claim 1, wherein said biasing rod sections of said first and second pressing members are adapted to extend from said shaft seat toward the inner surface of the adhesive tape roll away from each other, and said biasing rod sections of said first and second supporting members are adapted to extend from said shaft seat toward the inner surface of the adhesive tape roll away from each other.

3. The adhesive tape cutting device as claimed in claim 1, wherein said cutting unit further includes two return plates extending respectively from said first pressing member and said first supporting member toward each other, so as to define a tape passage space between said shaft seat and said return plates, thereby allowing the peeled tape section to extend through the tape passage space to thereby be adhered to said return plates.

4. The adhesive tape cutting device as claimed in claim 3, wherein said cutting member is connected pivotally to said shaft seat, and is rotatable relative to said return plates between a cutting position and a non-cutting position such that, when said cutting member is at the cutting position, said blade is adjacent to said return plates, and is adapted to press the peeled tape section against the outer surface of the adhesive tape roll, so as to allow the peeled tape section to be pulled and thus cut off, and when said cutting member is at the non-cutting position, said blade are far away from said return plates.

5. The adhesive tape cutting device as claimed in claim 4, wherein said cutting unit further includes a pressing plate disposed on said cutting member and positioned so as to clamp the peeled tape section between said pressing plate and said return plates.

6. The adhesive tape cutting device as claimed in claim 5, wherein said supporting unit further includes a second pressing member disposed on said shaft seat and adjacent to said first pressing member, and a second supporting member disposed on said shaft seat and adjacent to said first supporting member, such that said first pressing member and said first supporting member are located at a side of said shaft seat, and said second pressing member and said second supporting member are located at an opposite side of said shaft seat, said second pressing member having a biasing rod section extending from said shaft seat and adapted to be adjacent to the first side surface of the adhesive tape roll, and a pressing portion extending from said biasing rod section toward said second supporting member and adapted to press against an inner surface of the adhesive tape roller, said second supporting member having a biasing rod section extending from said shaft seat and adapted to be adjacent to the second side surface of the adhesive tape roll such that said biasing rod sections of said second pressing member and said supporting member flank the adhesive top roll, and a retaining portion connected to said biasing rod section of said second supporting member and retaining removably said pressing portion thereon, such that said biasing rod sections of said second pressing member and said second supporting member cooperate to bias said pressing portion of said second pressing member to press against the inner surface of the adhesive tape roll.

7. The adhesive tape cutting device as claimed in claim 6, wherein each of said first and second pressing members and said return plates is made of a flexible material such that, when a force is applied to press downwardly said cutting member against said return plates and when the peeled tape section is cut off, free ends of said return plates are moved downwardly, and when the force is released, the free ends of said return plates return to their original positions to thereby pivot upwardly said cutting member and move upwardly a portion of the peeled tape section remaining on a rolled section of the adhesive tape roll, so that a free end of the portion of the peeled tape section adjacent to said blade is removed from the rolled section of the adhesive tape roll.

8. The adhesive tape cutting device as claimed in claim 6, wherein said return plates are spaced apart from each other by a finger passage space, so that fingers of a user can be extended through said finger passage space for pulling out the peeled tape section through said tape passage space.

9. The adhesive tape cutting device as claimed in claim 6, wherein said pressing portion of each of said first and second pressing members is configured as a rod, and has an enlarged free end and an engaging portion adjacent to said enlarged free end and engaging said retaining portion of a corresponding one of said first and second supporting members.

* * * * *